US007594506B2

(12) United States Patent
Lundberg

(10) Patent No.: US 7,594,506 B2
(45) Date of Patent: Sep. 29, 2009

(54) STOVE WITH DOOR OPENING MECHANISM

(76) Inventor: William Richard Lundberg, 30252 U.S. Highway 71, Sebeka, MN (US) 56477

( * ) Notice: Subject to any disclaimer, the term of this patent is extended or adjusted under 35 U.S.C. 154(b) by 255 days.

(21) Appl. No.: 11/534,889

(22) Filed: Sep. 25, 2006

(65) Prior Publication Data

US 2007/0068506 A1 Mar. 29, 2007

Related U.S. Application Data

(60) Provisional application No. 60/720,415, filed on Sep. 26, 2005.

(51) Int. Cl.
*F24B 3/00* (2006.01)

(52) U.S. Cl. ..... 126/67; 126/68

(58) Field of Classification Search ..... 126/68, 126/192, 197, 67; 220/203.01, 203.07, 262, 220/502, 263; 37/444; 414/160, 162, 163, 414/164, 167, 172, 387, 388, 389, 394
See application file for complete search history.

(56) References Cited

U.S. PATENT DOCUMENTS 1,152,999 A * 9/1915 Williamson ..... 49/270
1,366,072 A * 1/1921 Hall ..... 110/176
1,429,108 A * 9/1922 Schaumburger et al. ..... 74/560
1,495,503 A * 5/1924 Armstrong ..... 373/127
1,519,838 A * 12/1924 Horton ..... 110/178
1,754,095 A * 4/1930 Gohmann ..... 110/178
1,784,588 A * 12/1930 Green ..... 206/361
2,041,038 A * 5/1936 Wisner ..... 220/263
2,394,811 A * 2/1946 Rymer ..... 126/190
2,398,508 A * 4/1946 Edbert ..... 99/390
2,804,855 A * 9/1957 Bergman ..... 122/498
2,807,107 A * 9/1957 Alphonse ..... 49/106
2,861,366 A * 11/1958 Denison ..... 49/269
3,121,419 A * 2/1964 Gillespie ..... 119/62
3,938,451 A * 2/1976 Lucas, Jr. ..... 110/109
4,131,104 A * 12/1978 Choate ..... 126/60
4,213,446 A 7/1980 Stookey et al.
4,261,267 A * 4/1981 Lesmeister et al. ..... 110/173 R
4,280,476 A * 7/1981 Webb ..... 126/286
4,361,247 A * 11/1982 Williams ..... 220/88.1
4,362,146 A * 12/1982 Schuller ..... 126/504
4,424,799 A * 1/1984 Patterson ..... 126/289
4,442,825 A 4/1984 Waldau
4,450,335 A * 5/1984 Shimizu et al. ..... 219/723
4,566,223 A * 1/1986 Romberg ..... 49/264

(Continued)

FOREIGN PATENT DOCUMENTS

GB 2213574 A * 8/1989

*Primary Examiner*—Kenneth B Rinehart
*Assistant Examiner*—Jorge Pereiro
(74) *Attorney, Agent, or Firm*—IPLM Group, P.A.

(57) ABSTRACT

A stove with a door opening mechanism is provided. The stove includes a stove housing, a stove door a sensing device and an activation mechanism. The stove housing forms a fuel chamber. The stove door is pivotally coupled to the stove housing to provide access to the fuel chamber. The sensing device is adapted to sense a condition that indicates fuel is about to be placed in the fuel chamber. The activation mechanism is adapted to open the stove door in response to the sensing device sensing a condition that indicates fuel is about to be placed in the fuel chamber.

10 Claims, 7 Drawing Sheets

U.S. PATENT DOCUMENTS 4,646,712 A * 3/1987 Ferguson et al. ..... 126/79
4,658,545 A * 4/1987 Ingham et al. ..... 49/340
4,676,734 A * 6/1987 Foley ..... 431/12
4,697,380 A * 10/1987 Fenske ..... 43/55
4,768,670 A * 9/1988 Lin ..... 294/68.24
4,793,290 A * 12/1988 O'Donnell ..... 119/62
5,097,616 A * 3/1992 Johnston, Jr. ..... 43/4
5,147,056 A * 9/1992 Ma ..... 220/263
5,163,574 A * 11/1992 Sosan ..... 220/264
5,299,882 A * 4/1994 Sayers ..... 404/6
5,403,548 A * 4/1995 Aibe et al. ..... 422/5
5,531,348 A * 7/1996 Baker et al. ..... 220/264
5,622,416 A * 4/1997 Rainey et al. ..... 312/319.9
5,720,132 A * 2/1998 Renner et al. ..... 49/263
5,918,588 A * 7/1999 Gil Garcia ..... 126/41 R
6,000,938 A * 12/1999 Melanowicz ..... 432/250
6,024,238 A * 2/2000 Jaros ..... 220/264
6,039,200 A * 3/2000 Armor ..... 220/263
6,125,773 A * 10/2000 Coble ..... 110/176
6,186,306 B1 * 2/2001 Kamm ..... 193/31 A
6,227,608 B1 * 5/2001 Hoyne ..... 296/183.1
6,267,260 B1 * 7/2001 Lyons ..... 220/212.5
6,485,296 B1 * 11/2002 Bender et al. ..... 432/58
6,581,587 B1 * 6/2003 Helms ..... 126/25 R
6,789,537 B1 * 9/2004 Lutz et al. ..... 126/25 R

* cited by examiner

STOVE WITH DOOR OPENING MECHANISM

RELATED APPLICATION

The present application claims priority to the provisional application entitled "Stove Door Opening Apparatus" filed on Sep. 26, 2005 having the Provisional Application No. 60/720,415.

BACKGROUND

Large stoves such as outdoor wood furnaces are built to hold a large amount of fuel so they can operate for a relatively long time period without re-fueling. To operate one of these large furnaces, a door of the furnace must be first opened by hand and the wood or other combustible fuel must then be thrown in the combustion chamber of the furnace or stove. Once all the fuel has been placed in the stove the door must be closed. Placing of the fuel in the stove can take a great amount of effort and time. For example, with stove furnaces that are adapted to except large logs as fuel, the person fueling the stove has to be relatively strong to be able to throw in all the logs needed to fuel the stove. The same is true for the furnaces adapted to except corn, corn stocks, wood pellets and the like. In these types of stoves the fuel must be shoveled into the fuel chamber of the stove once the door has been opened.

For the reasons stated above and for other reasons stated below which will become apparent to those skilled in the art upon reading and understanding the present specification, there is a need in the art for a stove with a door that provides easy access to a fuel chamber for loading of fuel.

SUMMARY OF INVENTION

The above-mentioned problems of current systems are addressed by embodiments of the present invention and will be understood by reading and studying the following specification. The following summaries are made by way of example and not by way of limitation. They are merely provided to aid the reader in understanding some of the aspects of the invention.

In one embodiment, a stove is provided. The stove includes a stove housing, a stove door, a sensing device and an activation mechanism. The stove housing forms a fuel chamber. The stove door is pivotally coupled to the stove housing to provide access to the fuel chamber. The sensing device is adapted to sense a condition that indicates fuel is about to be placed in the fuel chamber. The activation mechanism is adapted to open the stove door in response to the sensing device sensing a condition that indicates fuel is about to be placed in the fuel chamber.

In another embodiment, another stove is provided. The stove includes a stove housing, a stove door and an activation plate. The stove housing encases a fuel chamber. The stove door is adapted to allow access to the fuel chamber. Moreover, the activation plate is coupled to the door. The activation plate is adapted to open the stove door when a select amount of weight is placed on the activation plate.

In still yet another embodiment, another stove is provided. The stove includes a stove housing, a stove door, a base, an activation plate and at least one connection mechanism. The stove housing encases a fuel chamber. The stove door is pivotally coupled to allow access to the fuel chamber. The activation plate is pivotally coupled to the base, wherein the base and activation plate form a ramp. In addition, the at least one connection mechanism is pivotally coupled between the stove door and the activation plate, wherein the stove door opens when the activation plate is rotated in relation to the base via the at least one connection mechanism.

BRIEF DESCRIPTION OF THE DRAWINGS

The present invention can be more easily understood and further advantages and uses thereof more readily apparent, when considered in view of the description and the following Figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide a stove that has a stove door that opens to a fuel chamber without the operator having to use his or her arms when loading fuel into the fuel chamber. In one embodiment, the stove door opens when a select pressure or weight is asserted on an activation plate that is pivotally connected to the stove door. In another embodiment, the stove door is designed to be opened when a vehicles wheel or wheels are driven upon the activation plate. In another embodiment, the stove door is designed to be opened when a condition indicates that fuel is about to be loaded into the stove. These embodiments as well as other embodiments are described below.

Figure 1:
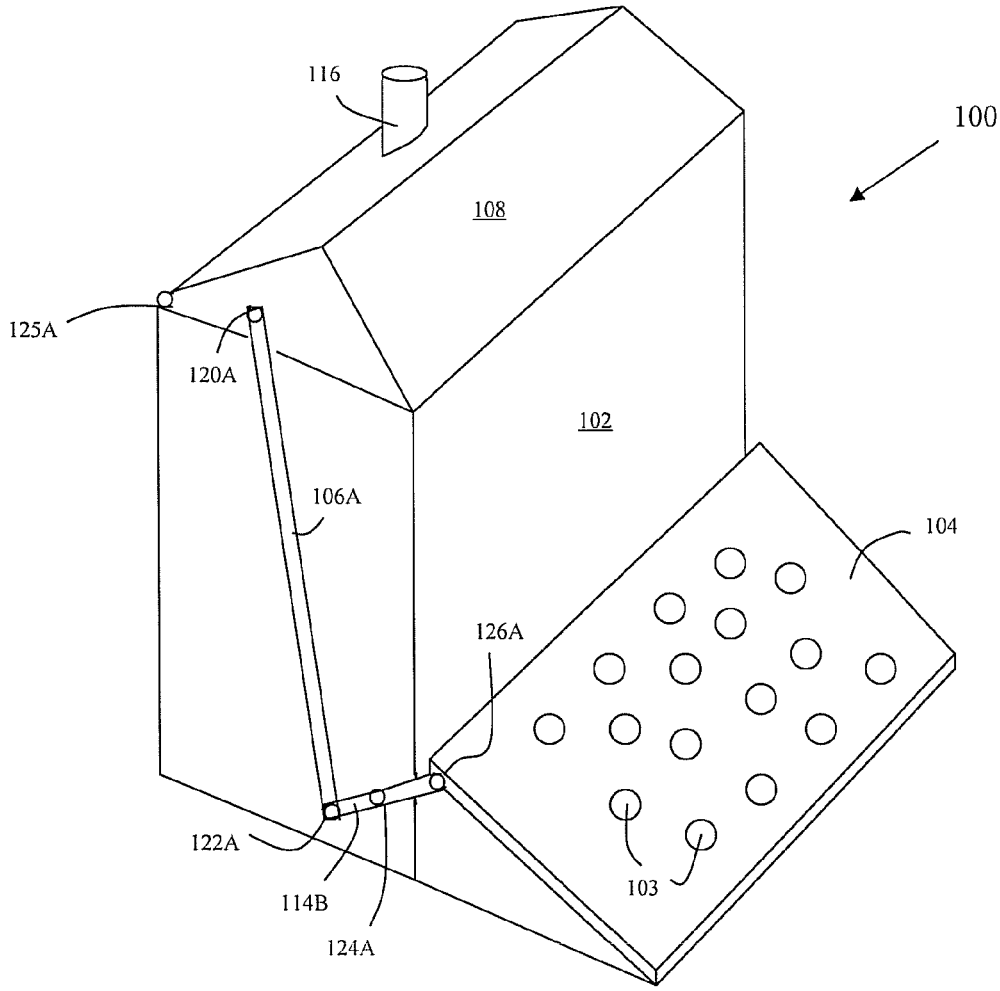
FIG. 1 is a side perspective view of one embodiment of the present invention.

Referring to FIG. 1, a side perspective view of a stove 100 of one of embodiment of the present invention. As illustrated, stove 100 includes a stove housing 102, a stove door 108 and an activation plate 104. The stove door 108 is movably (or pivotally) attached to the stove housing 102 via pivot 125A. The stove door 108 is further movably coupled to the activation plate 104 via an activation mechanism (or a connection mechanism) made up of a first connection rod 106A and a second connection rod 114A. As illustrated, the first connection rod 106A has a first end pivotally coupled to the stove door 108 via pivot 120A and a second end pivotally coupled to a first end of the second connection rod 114A via pivot 122A. A second end of the second connection rod 114A is pivotally coupled to the activation plate 104 via pivot 126A. Moreover, the second connection rod 114A is pivotally coupled to the stove housing 102 via pivot 124A. The activation plate 104 is positioned near the ground in this embodiment. The stove door 108 opens when a weight is placed on the activation plate 104. Also illustrated in FIG. 1 is an exhaust port 116 that allows for the escape of the combustion fumes. Further illustrated are traction apertures 103 in the activation plate 104. The traction apertures 103 provide added traction when a vehicle, person or other object is engaging the activation plate 104.

Figure 2:
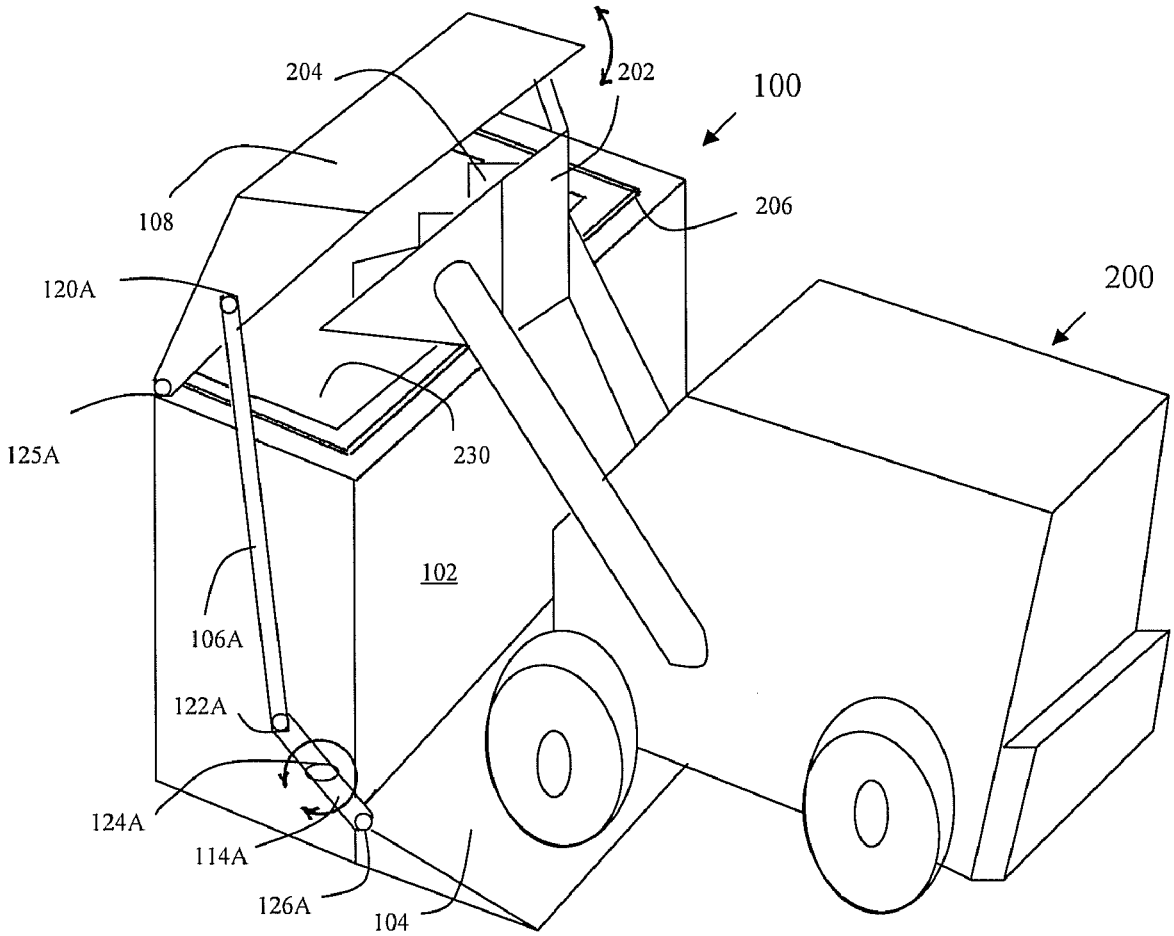
FIG. 2 is a side perspective view of the embodiment of FIG. 1 being loaded with fuel.

Referring to FIG. 2, a side perspective view of stove 100 being supplied with fuel is provided. As illustrated, a front end loader 200 having a bucket 202 filled with fuel 202 is driven upon the activation plate 104. In response to the activation plate 104 being depressed, the activation mechanism causes the stove door to open. In particular, the movement of the activation plate 104 causes the second connection rod 114A of the activation mechanism to pivot about pivot 124A. This causes the first connection rod 106A to rise thereby lifting the stove door 108 off of the stove housing 102. Once the stove door 108 is opened, the bucket 202 containing the fuel 204 is rotated to dump the fuel 204 into a fuel chamber 230 of the stove 100. Any type of combustible fuel can be used in the stove 100 such as wood logs, wood pellets, corn, corn stalks and the like. In one embodiment, a gasket 206 is used to provide an air tight seal between the stove door 108 and the stove housing 102 when the stove door 108 is closed. The gasket 206 is made of a material with a high resistance to combustibility. That is, the gasket material will not burn up or break down when exposed to the heat generated by the stove 100.

As discussed above, the stove door 108 remains closed when no pressure is asserted on the activation plate 104. In particular, the weight of the door 108 keeps the door 108 closed and the activation plate 104 in a non-activated position when a weight exceeding a select amount is not on the activation plate 104. The amount of weight needed to open the door 108 can be adjusted by changing the weight of the stove door 108 or the weight of the activation plate 104 in this embodiment. Hence, a stove door could be selected that was heavy enough so that a child could not open the door by stepping on the activation plate 104 but could be opened by an adult. Hence, this embodiment is not limited to a specific vehicle, object or person to open the stove door 108 but by a specific weight placed on the activation plate 104.

Figure 3:
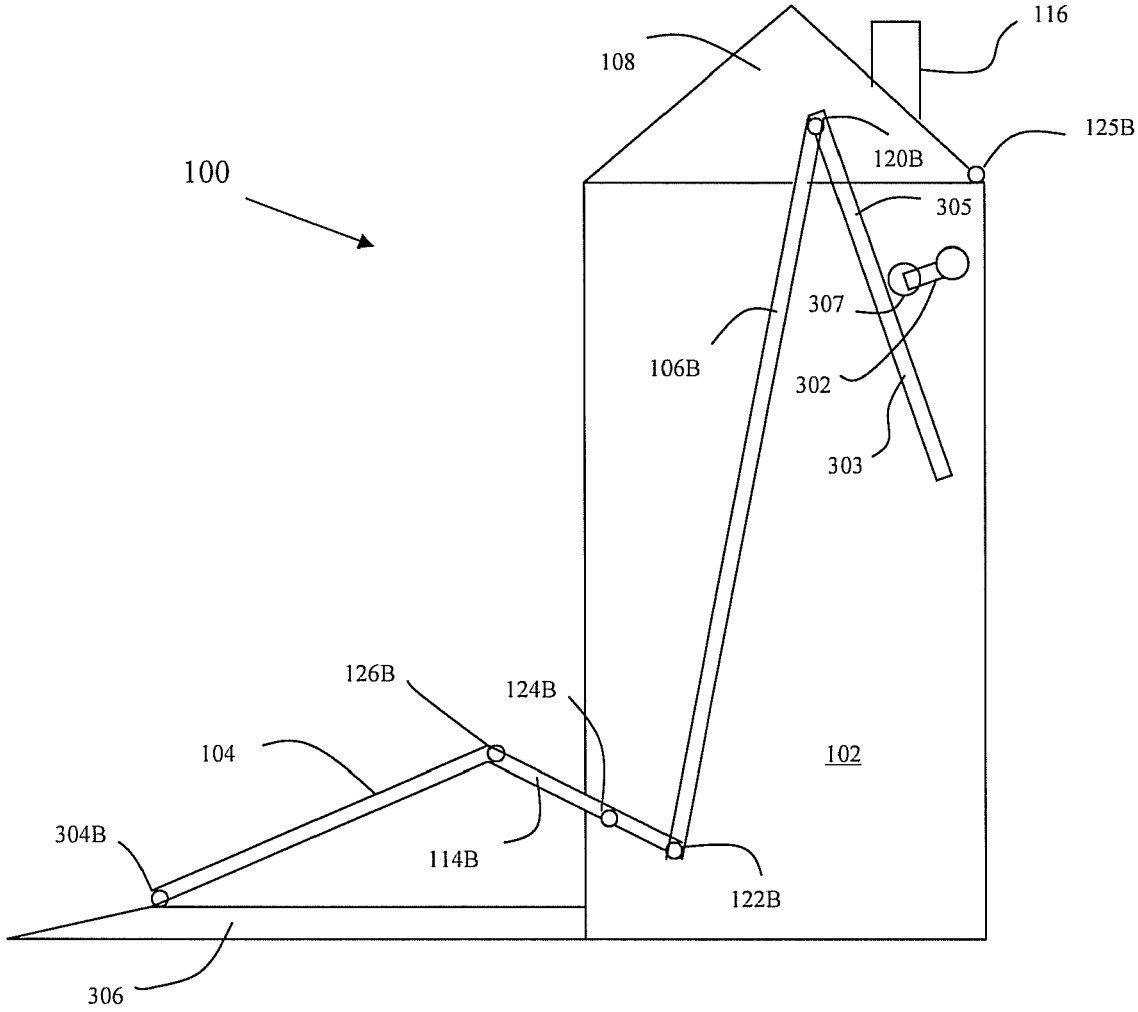
FIG. 3 is a right side view of the embodiment of FIG. 1.

FIG. 3 illustrates a right side view of the stove 100. As illustrated, in this embodiment, a second activation mechanism comprising first connection rod 106B and second connection rod 114B is also used on the opposite side as the first activation mechanism. A first end of first connection rod 106B is pivotally coupled to the stove door 108 via pivot 120B and a second end of first connection rod 106B is pivotally connected to a first end of second connecting rod 114B by pivot 122B. A second end of second connection rod 114B is pivotally connected to the activation plate via pivot 126B. Moreover, second connection rod 114B is pivotally connected to the stove housing 102 via pivot 124B. As further illustrated in this embodiment, the activation plate 104 is pivotally coupled to a base 306 via pivot 304B. It will be understood by those skilled in the art that the pivot could be a hinge or any type of connection that allows rotation and that the terms "pivot" and pivotally connected" refer generally to any type of connection that allows rotation. The activation plate 104 and base 306 form a ramp in this embodiment.

FIG. 3 also illustrates an auxiliary hand crank 302 that is movably connected to a secondary connection rod 303 to manually open the stove door 108. This allows for an alternative method of opening the stove door 108. It can also be used if the other mechanism provided to open the stove door 108 becomes inoperable. In one embodiment, a gear 307 of the hand crank 302 is engaged with receiving notches (not shown) on a surface 305 of the secondary connection rod 303 to move the secondary connection rod 303.

Figure 4:
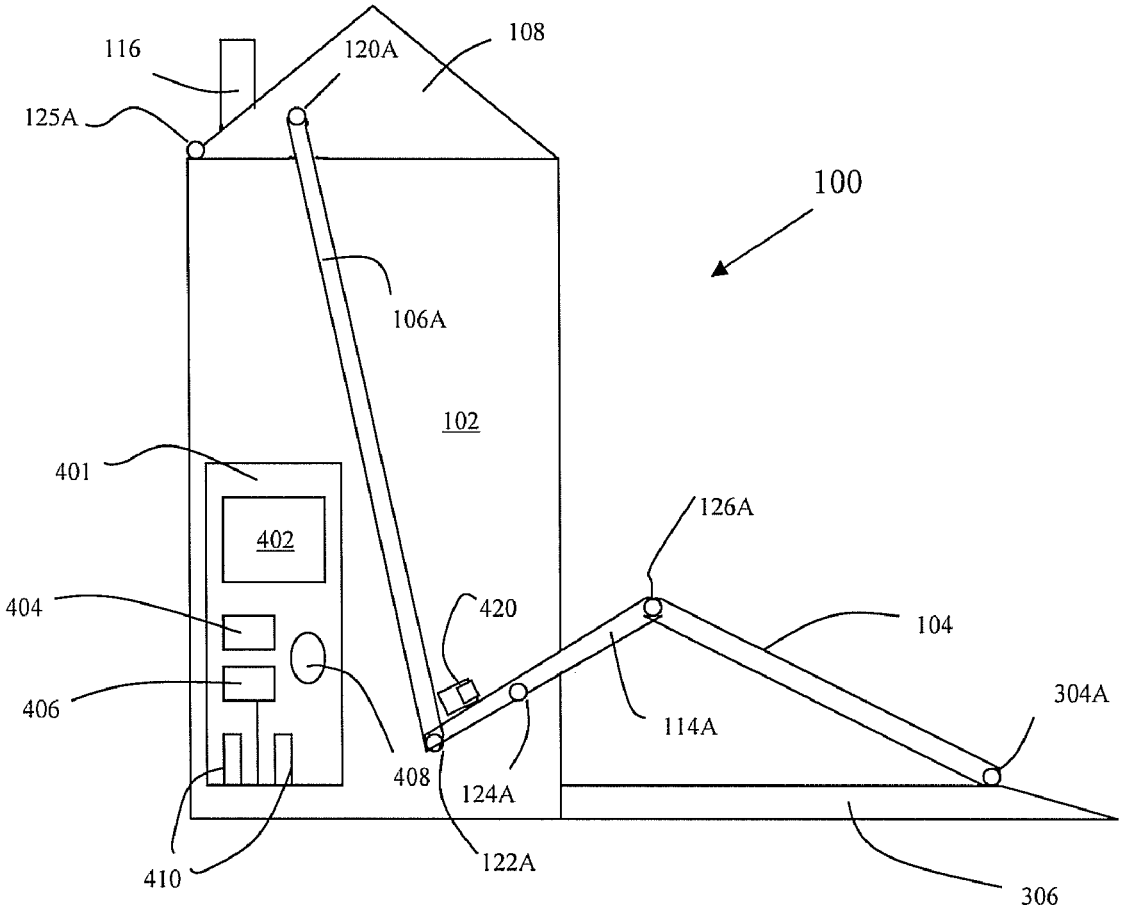
FIG. 4 is a left side view of the embodiment of FIG. 1.

A left side view of an embodiment of stove 100 is illustrated in FIG. 4. As illustrated, the activation plate 104 is pivotally connected to the base 306 via pivot connection 304A. Also illustrated in FIG. 4 is a control panel 401 that controls operations of the stove 100. The control panel 104 in this embodiment includes a fire box entrance door 402, a damper control 404, a controller 406, water controls 410 and a fan 408. Among other functions, the fire box entrance 402 allows for the removal of ash and the like. The fan 408 and the damper control 104 are used to control the intensity of the burn in the fire chamber 230. The controller 406 is electrically connected to the various devices, such as the fan 408 and damper control 404 to provide power and control the devices. In one embodiment, water controls 410 allows for a circulation of water or a mixture that includes water to pass through the stove housing 102. This allows for heated water or mixture that includes water to be used as a source of heat.

FIG. 4, also illustrates switch 420 that is in communication with the second connection rod 114A. In particular, when the second connection rod 114A is rotated, switch 420 is activated. Switch 420 is further in communication with the controller 406. In response to the switch indicating the stove door 108 is opening, the controller 406 adjusts at least one of the damper 404 and the fan 408 to reduce the rate of combustion in the fuel chamber. Moreover, in response to the switch 420 indicating the stove door is closed, the controller 406 adjusts at least one of the damper 404 and the fan 408 to increase the rate of combustion in the fuel chamber.

Figure 5:
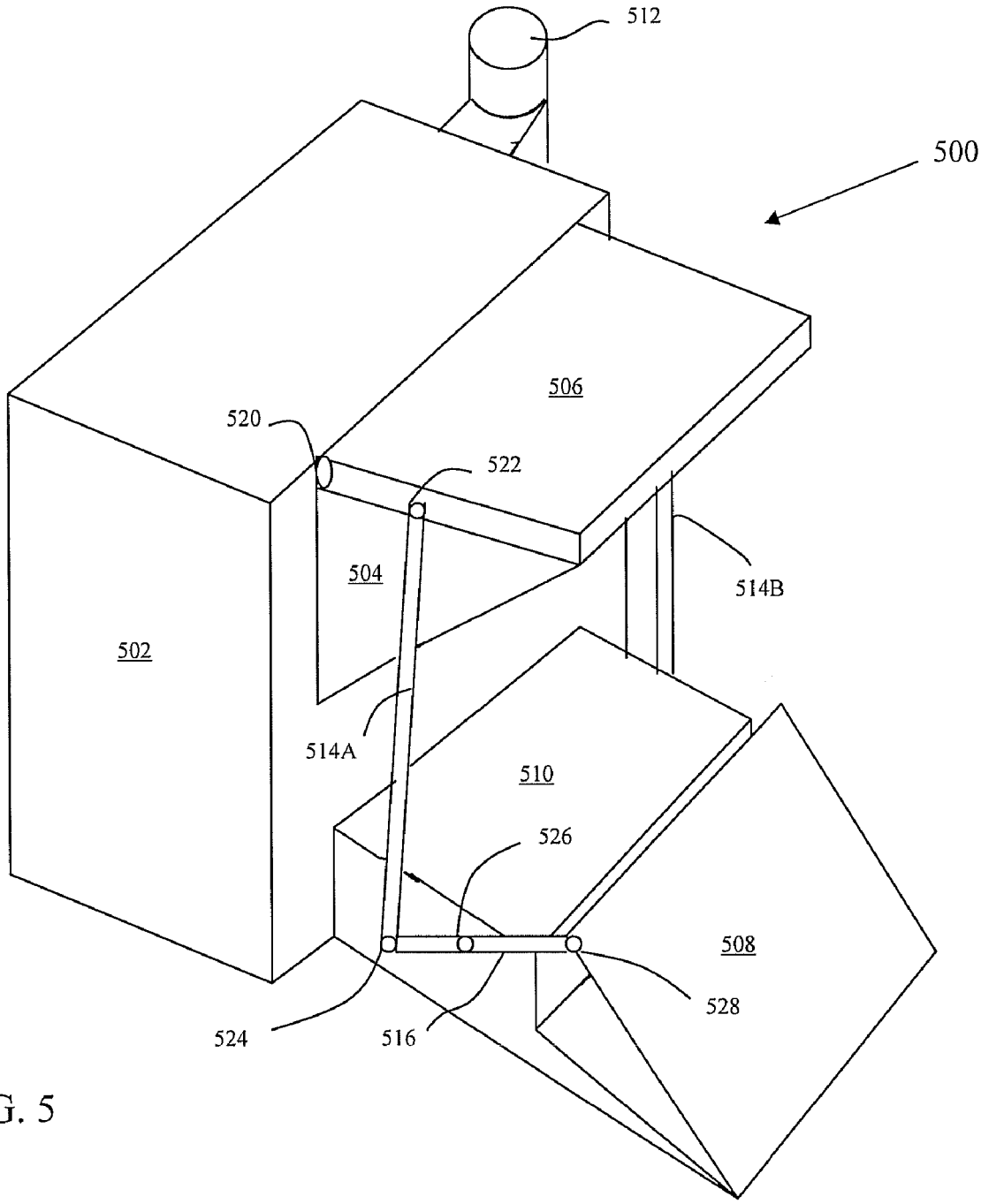
FIG. 5 is a side perspective view of another embodiment of the present invention.

Referring to FIG. 5, another embodiment of a stove 500 of the present invention is provided. As illustrated, this embodiment includes stove housing 502, a holding bin 504, a stove door 506 and an activation plate 508. The stove door 506 in this embodiment encloses the holding bin 504 when in a closed position as illustrated in FIG. 5. As illustrated, the stove door 506 is pivotally connected to the holding bin 504 via pivot 520. The stove door 506 is further connected to the activation plate 508 via first connection rods 514A and 514B. In regards to the view illustrated in FIG. 5, a second connection rod 516 connects the first connection rod 514A to the activation plate 508. In particular, a first end of the first connection rod 514A is pivotally connected to the stove door 506 via pivot 522 and a second end of the first connection rod 514A is pivotally connected to a first end of the second connection rod 516 via pivot 524. A second end of the second connection rod 516 is pivotally connected to the activation plate 508 via pivot 528. In addition, the second connection rod 516 is pivotally connected to a base 510 via pivot 526. A similar connection mechanism that includes first connection rod 514B is provided on the other side of the stove 500. Also illustrated in FIG. 5 is an exhaust port 512 to exhaust combustion fumes.

Figure 6:
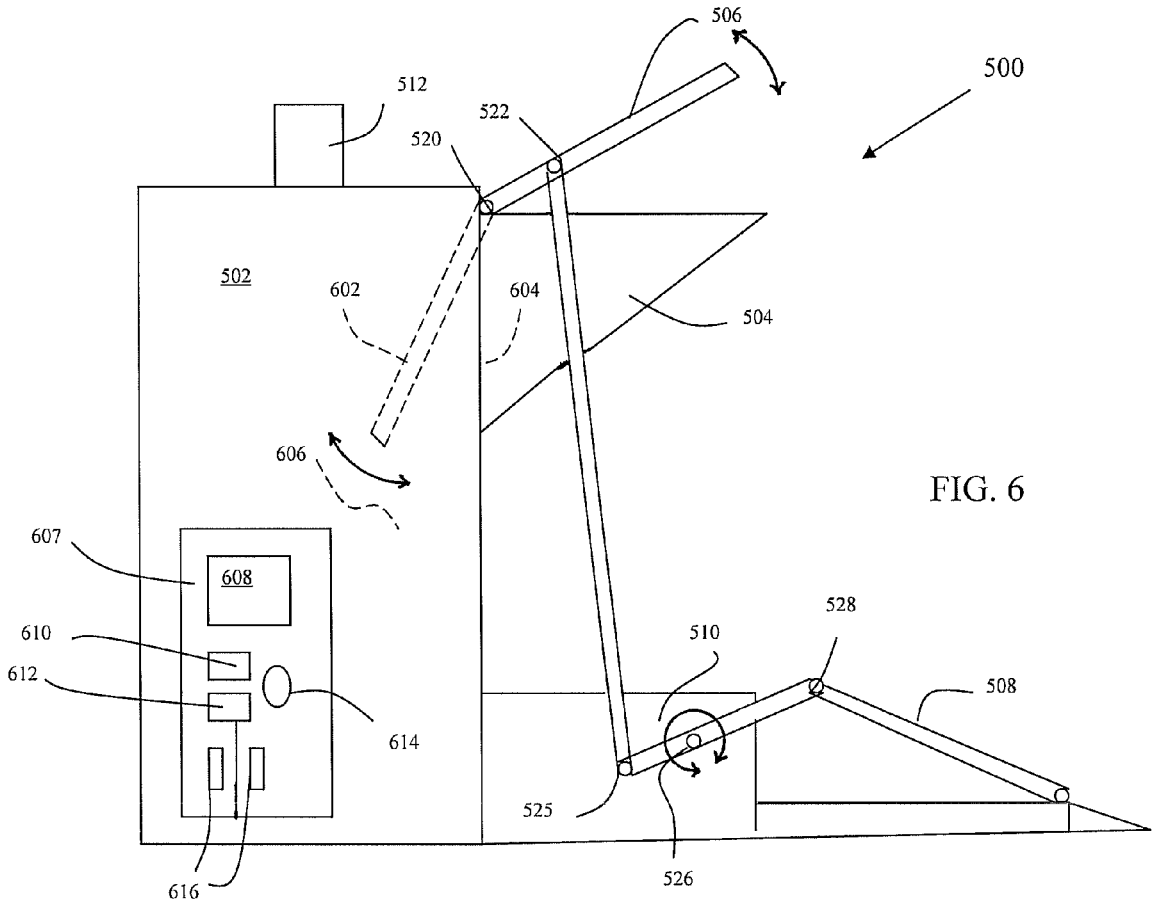
FIG. 6 is a side view of the embodiment of FIG. 5.

FIG. 6, illustrates the stove door 506 of stove 500 being opened. As illustrated, in this embodiment a holding plate 602 that is coupled to the stove door 506 is designed to cover an opening 604 between the holding bin 504 and a fire chamber 606 when the stove door 506 is fully opened. This helps prevent fire and ashes from escaping from the fire chamber 606 when the door 506 is opened. Once the door is opened, the fuel is placed in the holding bin 504. The fuel is held in the holding bin 504 by the holding plate 620 until the stove cover 506 is closed. In particular, as the stove door 506 closes, the fuel is released from the holding bin 504 into the fire chamber 606. Also illustrated in FIG. 6, is a control panel 607 which includes a fire box entrance 608, a damper control 610, a fan 614, controller 612 and water control 616.

Figure 7:
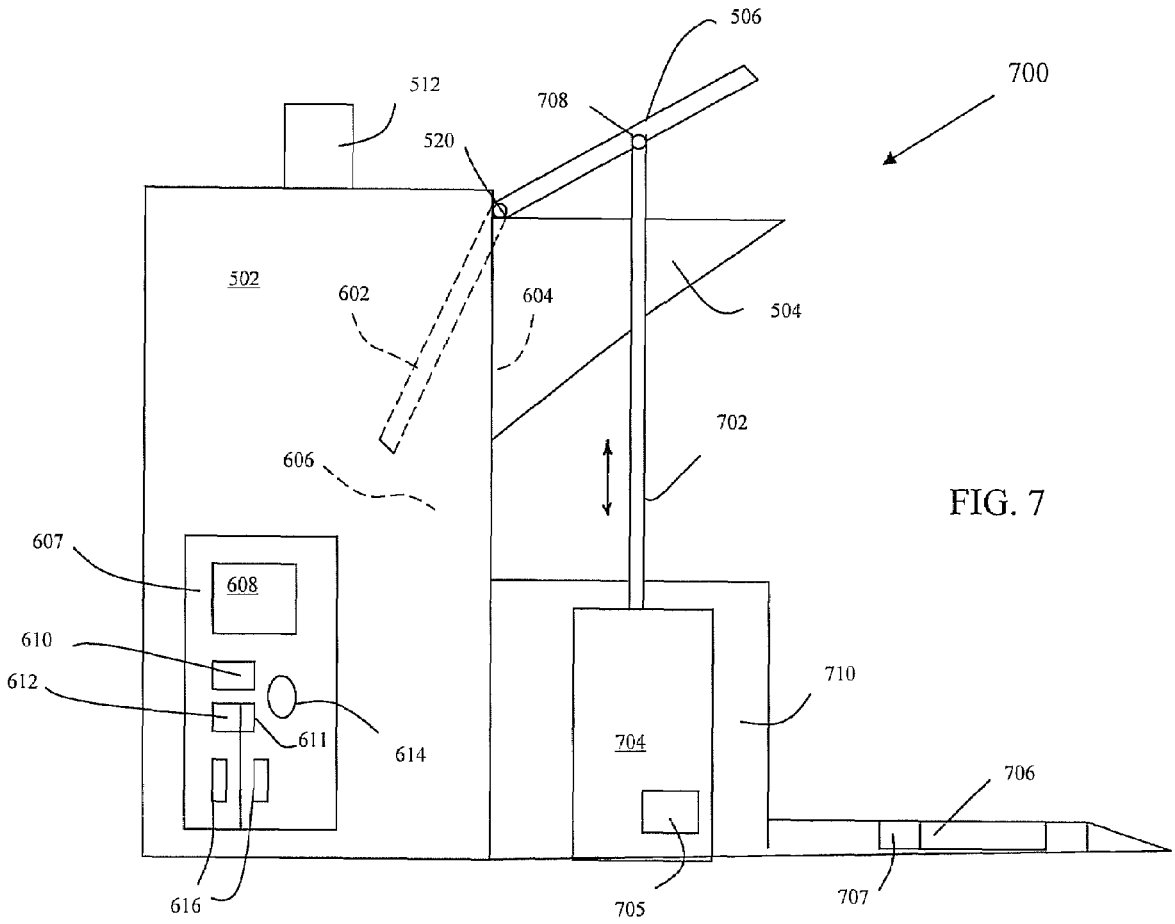
FIG. 7 is still another embodiment of the present invention.

Referring to FIG. 7, another embodiment of a stove 700 is provided. In this embodiment, the stove door 506 is opened from the holding bin 504 by a lifting device 704. The activation mechanism includes lifting device 704 and a connecting rod 702 that is pivotally connected to the stove door 506 via pivot 708. The lifting device 704 is designed to selectively move the connection rod 702 up and down. In one embodiment, the activation mechanism includes a lifting device 704 that is an electromechanical device, including but not limited to a solenoid, to accomplish the up and down movement of the connection rod 702. In another embodiment, the activation mechanism includes a lifting device 704 that is a hydraulic system to accomplish the up and down movement of the connection rod 702. Although, the lifting device 704 in this embodiment is shown as being coupled to a base 710, other embodiments envision other placements, which include but are not limited to, a direct connection to the stove housing.

The lifting device 704 is activated when it receives an activation signal from a sensing device such as sensor 706. The sensor 706 provides a signal when the sensor 706 senses a condition that indicates fuel is about to be added to the stove 700. Different types of sensors are contemplated. For example, a weight sensor could be used. In another embodiment, a motion sensor is used. In other embodiments, a sensor that is designed to detect a designated signal is used. For example, the signal may be a signal from a remote garage door opener that has its signal programmed to be detected by the sensor 706 or the like. Moreover, in one embodiment a radio frequency identification (RFID) tag system is used such that when an active or passive RFID tag is detected near the sensor 706 the activation signal is generated to activated the lifting device 704. In these embodiments, the lifting device 704 will only be activated to open the stove door 506 upon receiving an activation signal from the sensor 706. In this manner only authorized user will be able to open the stove door 506.

In one embodiment, the sensor 706 communicates with the lifting device 704 with a transmitter 707 in the sensor 706 and a receiver in the lifting device 704. In one embodiment, the transmitter 707 is hard wired to the receiver 705. In another device the transmitter 707 is wirelessly in communication with the receiver 705. In another, embodiment, the controller 612 includes a receiver 611 that is in communication with the lifting mechanism 704. In this embodiment, when an activation signal has been detected, the controller 612 adjusts the dampening control 610 and the fan 614 to reduce the combustion rate in the fire chamber 606 to reduce the possibility of flames escaping from the stove 700 when the door is opening.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A stove, the stove comprising:

a stove housing, the stove housing forming a fuel chamber;

a stove door pivotally coupled to the stove housing to provide access to the fuel chamber;

a ramp coupled to the stove housing, the ramp configured to engage at least one wheel of a fuel carrying device to position the fuel carrying device to supply fuel to the fuel chamber;

a sensing device on the ramp adapted to sense a condition that indicates fuel is about to be placed in the fuel chamber; and an activation mechanism adapted to open the stove door in response to the sensing device sensing a condition that indicates fuel is about to be placed in the fuel chamber.

2. The stove of claim 1, wherein the sensing device further comprises:

an activation plate that is adapted to rotate on at least one pivot when a weight of a select amount is placed on the activation plate.

3. The stove of claim 2, wherein the activation mechanism further comprises:

at least one first connection rod, the at least one first connection rod having a first end pivotally coupled to the stove door; and at least one second connection rod, the at least one second connection rod having a first end pivotally coupled to a second end of the at least one first connection rod and a second end of the at least one second connection rod pivotally coupled to the activation plate, the at least one second connection rod further being pivotally coupled to the stove housing.

4. The stove of claim 1, wherein the sensing device is a signal detecting device.

5. The stove of claim 1, wherein the sensing device is at least one of a scale, a motion detector and a radio frequency identification (RFID) detector.

6. The stove of claim 1, further comprising:

a holding bin between the fuel chamber and the stove door; and a holding plate coupled to the stove door, the holding plate adapted to separate the holding bin from the fuel chamber when the stove door is fully opened.

7. The stove of claim 1, further comprising:

a controller adapted to control at least one of a damper and a fan to reduce the combustion rate in the fuel chamber when the stove door is opened.

8. The stove of claim 1, further comprising:

heat resistance gasket material, the gasket material positioned to provide a relatively air tight seal around the stove door when the stove door is closed.

9. The stove of claim 1, further comprising:

an auxiliary hand crank adapted to open the stove door.

10. The stove of claim 1, wherein the activation mechanism includes at least one of an electro-mechanical device and a hydraulic system.

* * * * *

UNITED STATES PATENT AND TRADEMARK OFFICE

CERTIFICATE OF CORRECTION

PATENT NO. : 7,594,506 B2
APPLICATION NO. : 11/534889
DATED : September 29, 2009
INVENTOR(S) : William Richard Lundberg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 259 days.

Signed and Sealed this

Twenty-eighth Day of September, 2010

David J. Kappos

David J. Kappos
*Director of the United States Patent and Trademark Office*